US010480297B2

(12) United States Patent
Chidi et al.

(10) Patent No.: US 10,480,297 B2
(45) Date of Patent: Nov. 19, 2019

(54) HYDROCARBON WELLS AND METHODS COOPERATIVELY UTILIZING A GAS LIFT ASSEMBLY AND AN ELECTRIC SUBMERSIBLE PUMP

(71) Applicants: Jessica I. Chidi, Houston, TX (US); Michael C. Romer, The Woodlands, TX (US)

(72) Inventors: Jessica I. Chidi, Houston, TX (US); Michael C. Romer, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 176 days.

(21) Appl. No.: 15/714,499

(22) Filed: Sep. 25, 2017

(65) Prior Publication Data

US 2018/0163526 A1 Jun. 14, 2018

Related U.S. Application Data

(60) Provisional application No. 62/491,555, filed on Apr. 28, 2017, provisional application No. 62/432,178, filed on Dec. 9, 2016.

(51) Int. Cl.

| | |
|---|---|
| ***E21B 43/12*** | (2006.01) |
| *E21B 47/06* | (2012.01) |
| *F04B 47/00* | (2006.01) |

(52) U.S. Cl.

CPC ..... *E21B 43/121* (2013.01); *E21B 43/122* (2013.01); *E21B 43/128* (2013.01); *E21B 47/06* (2013.01); *F04B 47/00* (2013.01)

(58) Field of Classification Search

CPC ..... E21B 43/38; E21B 43/123; E21B 34/06; E21B 43/128; E21B 43/122;

(Continued)

(56) References Cited

U.S. PATENT DOCUMENTS 6,039,121 A * 3/2000 Kisman ..... E21B 43/121 166/272.7

6,328,102 B1 12/2001 Dean (Continued)

FOREIGN PATENT DOCUMENTS

| | | |
|---|---|---|
| EP | 2 077 374 A1 | 7/2009 |
| GB | 2 393 747 A | 4/2004 |

(Continued)

*Primary Examiner* — Michael R Wills, III

(74) *Attorney, Agent, or Firm* — ExxonMobil Upstream Research Company-Law Department

(57) ABSTRACT

Hydrocarbon wells and methods cooperatively utilizing a gas lift assembly and an electric submersible pump, the hydrocarbon wells including a wellbore extending between a surface region and a subterranean formation, a downhole tubular defining a tubular conduit and extending within the wellbore, an electric pumping assembly, an electric power source, and a gas lift assembly. The methods include generating a pumped reservoir fluid stream, generating a gas lifted reservoir fluid stream, conveying the pumped reservoir fluid stream to a surface region via an ESP conduit, and conveying the gas lifted reservoir fluid stream to the surface region via an annular space that is distinct from the ESP conduit.

26 Claims, 4 Drawing Sheets

(58) Field of Classification Search
CPC .... E21B 43/121; E21B 43/129; E21B 43/124; E21B 47/10; E21B 47/06; F04B 47/00
See application file for complete search history.

(56) References Cited

U.S. PATENT DOCUMENTS

| | | | | |
|---|---|---|---|---|
| 7,111,675 | B2 | 9/2006 | Zisk, Jr. | |
| 7,322,803 | B2 | 1/2008 | Vogeley | |
| 7,484,940 | B2 | 2/2009 | O'Niell | |
| 7,597,150 | B2 | 10/2009 | Clem | |
| 8,006,756 | B2 * | 8/2011 | Mazzanti | E21B 17/18 166/242.3 |
| 8,133,041 | B2 | 3/2012 | Ludlow et al. | |
| 8,220,533 | B2 | 7/2012 | Longfield et al. | |
| 8,511,390 | B2 | 8/2013 | Coyle et al. | |
| 8,985,221 | B2 * | 3/2015 | Mazzanti | E21B 17/18 166/106 |
| 2002/0121376 | A1 * | 9/2002 | Rivas | E21B 43/128 166/372 |
| 2002/0197174 | A1 | 12/2002 | Howard | |
| 2003/0010491 | A1 | 1/2003 | Collette | |
| 2003/0121656 | A1 * | 7/2003 | Hershberger | E21B 43/12 166/250.03 |
| 2006/0198742 | A1 | 9/2006 | DiFoggio et al. | |
| 2008/0080991 | A1 | 4/2008 | Yuratich et al. | |
| 2009/0183879 | A1 | 7/2009 | Cox | |
| 2009/0218091 | A1 | 9/2009 | Dotson | |
| 2010/0012313 | A1 | 1/2010 | Longfield | |
| 2010/0258306 | A1 * | 10/2010 | Camilleri | E21B 43/128 166/265 |
| 2012/0023606 | A1 | 1/2012 | Rehman | |
| 2013/0068454 | A1 * | 3/2013 | Armistead | E21B 43/121 166/265 |
| 2016/0258262 | A1 * | 9/2016 | Lemetayer | E21B 43/122 |
| 2016/0265333 | A1 * | 9/2016 | Roth | E21B 43/128 |
| 2017/0107811 | A1 * | 4/2017 | Romer | E21B 43/122 |

FOREIGN PATENT DOCUMENTS

| | | | |
|---|---|---|---|
| GB | 2 403 752 | A | 1/2005 |
| WO | WO 01/20126 | A2 | 3/2001 |
| WO | WO 2009/077714 | | 6/2009 |
| WO | WO 2011/079218 | A2 | 6/2011 |

* cited by examiner

HYDROCARBON WELLS AND METHODS COOPERATIVELY UTILIZING A GAS LIFT ASSEMBLY AND AN ELECTRIC SUBMERSIBLE PUMP

CROSS REFERENCE TO RELATED APPLICATIONS

This application claims the benefit of U.S. Provisional Application Ser. No. 62/491,555 filed Apr. 28, 2017 entitled "Hydrocarbon Wells and Methods Cooperatively Using a Gas Lift Assembly and an Electric Submersible Pump," and is related to and will claim benefit of U.S. Provisional Application Ser. No. 62/432,178 filed Dec. 9, 2016 entitled "Hybrid Coiled Tubing Gas Lift/ESP," the disclosures of which are incorporated herein by reference in their entireties.

FIELD OF THE DISCLOSURE

The present disclosure relates generally to hydrocarbon wells and methods that include and/or cooperatively utilize a gas lift assembly and an electric submersible pump (ESP), and more particularly to hydrocarbon wells and methods that cooperatively utilize the gas lift assembly and the ESP to produce separate and/or distinct streams from a subterranean formation.

BACKGROUND OF THE DISCLOSURE

Hydrocarbon wells generally include a wellbore that extends between a surface region and a subterranean formation that includes a reservoir fluid, such as a hydrocarbon. Certain hydrocarbon wells, which may be referred to herein as naturally flowing wells, may have a naturally occurring downhole pressure that is sufficient to convey the reservoir fluid to the surface region via the wellbore.

However, in other hydrocarbon wells, naturally occurring downhole pressure may be insufficient to produce, or to provide a motive force for production of, the reservoir fluids to the surface region. In such hydrocarbon wells, artificial lift technologizes may be utilized to convey, pump, and/or otherwise produce the reservoir fluids, via the wellbore, from the subterranean formation and/or to the surface region. Examples of such artificial lift technologies include hydraulic pumping systems, electric submersible pumps (ESPs), rod pumps, sub-surface pumping assemblies, and/or gas lift assemblies. While each of these artificial lift technologies may be effective at providing a motive force for production of the reservoir fluid, each suffers from inherent limitations.

As an example, downhole mechanical pumps may wear and/or may be prone to premature failure, requiring expensive and/or time-consuming intervention to repair and/or replace. As another example, gas lift assemblies may be inefficient, only may be capable of producing the reservoir fluid at relatively low flow rates, and/or may not be effective in gas-constrained formations and/or when gas availability is low. Thus, there exists a need for improved artificial lift technologies, such as hydrocarbon wells and methods cooperatively utilizing a gas lift assembly and an electric submersible pump.

SUMMARY OF THE DISCLOSURE

Hydrocarbon wells and methods cooperatively utilizing a gas lift assembly and an electric submersible pump are disclosed herein. The hydrocarbon wells include a wellbore extending between a surface region and a subterranean formation and a downhole tubular defining a tubular conduit and extending within the wellbore.

The hydrocarbon wells also include an electric pumping assembly including an electric submersible pump (ESP) and an ESP tubular that defines an ESP conduit. The ESP includes an ESP inlet, which is configured to receive a reservoir fluid into the ESP, and an ESP outlet, which is configured to discharge a pumped reservoir fluid stream from the ESP. The ESP is operatively attached to the ESP tubular such that the ESP conduit receives the pumped reservoir fluid stream from the ESP outlet. The electric pumping assembly is positioned within the tubular conduit such that the ESP tubular and the downhole tubular define an annular space therebetween, and the ESP tubular fluidly isolates the ESP conduit from the annular space.

The hydrocarbon wells further include an electric power source, which is configured to provide an electric current to the ESP to power the ESP, and a gas lift assembly. The gas lift assembly includes a lift gas source configured to generate a lift gas stream. The gas lift assembly also includes a lift gas injection point, which is uphole from the ESP inlet and is configured to inject the lift gas stream into the annular space to generate a gas lifted reservoir fluid stream. The gas lift assembly further includes a lift gas supply conduit, which is configured to convey the lift gas stream from the lift gas source to the lift gas injection point.

The methods include generating a pumped reservoir fluid stream with an electric pumping assembly and generating a gas lifted reservoir fluid stream with a gas lift assembly. The methods also include conveying the pumped reservoir fluid stream to a surface region via an ESP conduit and conveying the gas lifted reservoir fluid stream to the surface region via an annular space. The annular space is distinct from the ESP conduit.

DETAILED DESCRIPTION AND BEST MODE OF THE DISCLOSURE

Figure 1:
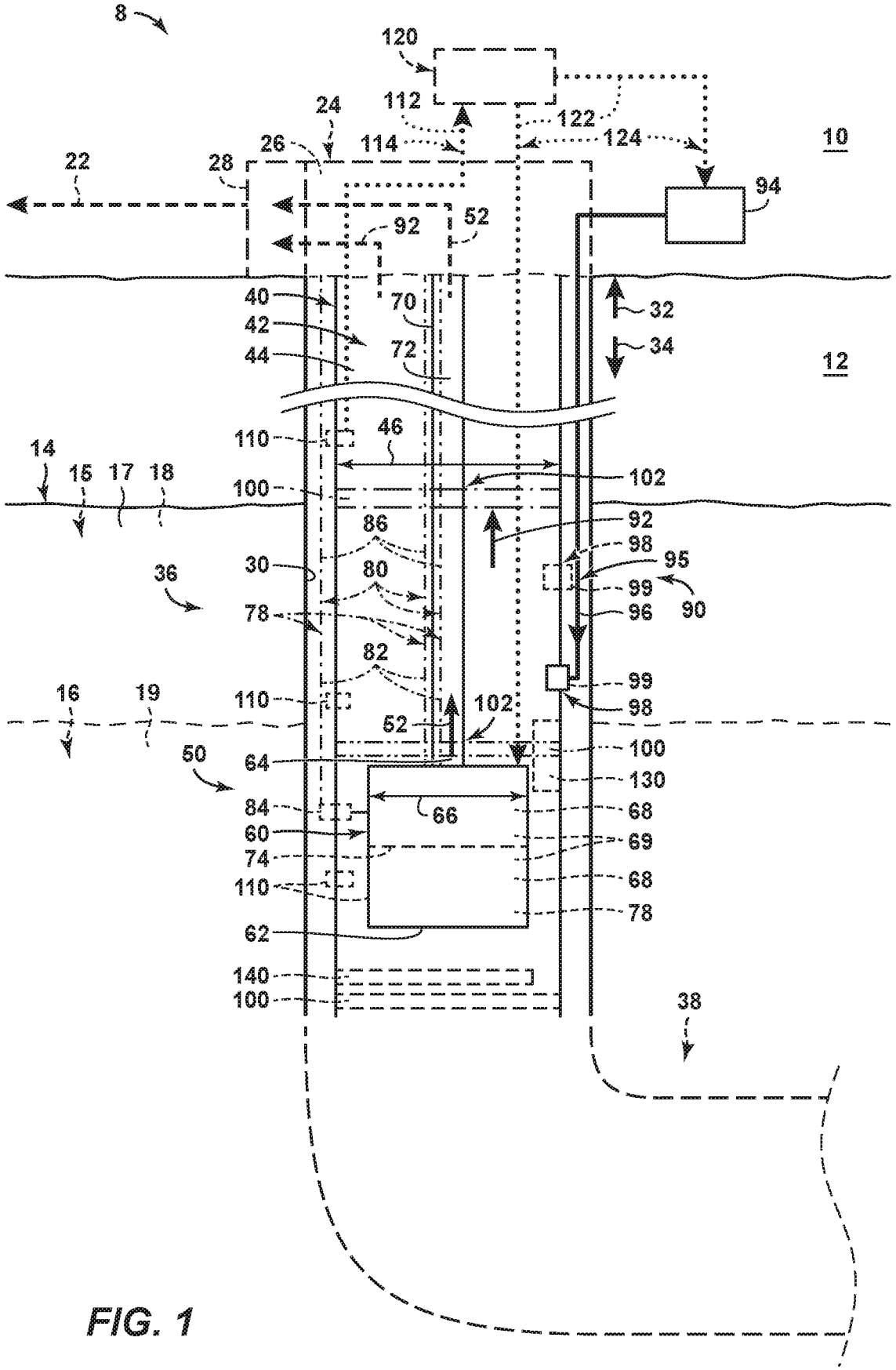
FIG. 1 is a schematic cross-sectional view of hydrocarbon wells, according to the present disclosure, including both an electric pumping assembly and a gas lift assembly.

FIGS. 1-4 provide examples of hydrocarbon wells 8 and/or of methods 200, according to the present disclosure. Elements that serve a similar, or at least substantially similar, purpose are labeled with like numbers in each of FIGS. 1-4, and these elements may not be discussed in detail herein with reference to each of FIGS. 1-4. Similarly, all elements may not be labeled in each of FIGS. 1-4, but reference numerals associated therewith may be utilized herein for consistency. Elements, components, and/or features that are discussed herein with reference to one or more of FIGS. 1-4 may be included in and/or utilized with any of FIGS. 1-4 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

Figure 2:
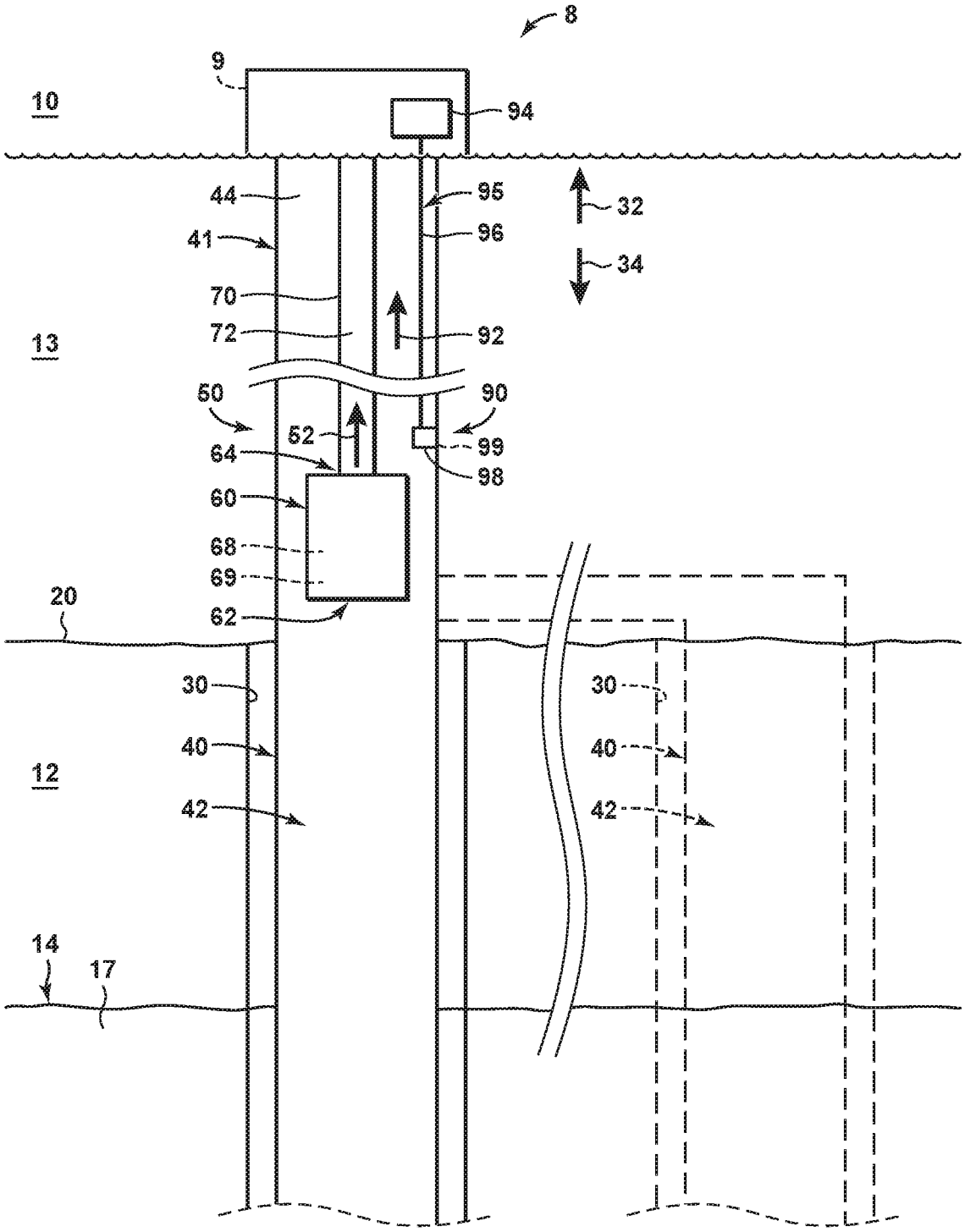
FIG. 2 is a schematic cross-sectional view of hydrocarbon wells, according to the present disclosure, including both an electric pumping assembly and a gas lift assembly.
Figure 3:
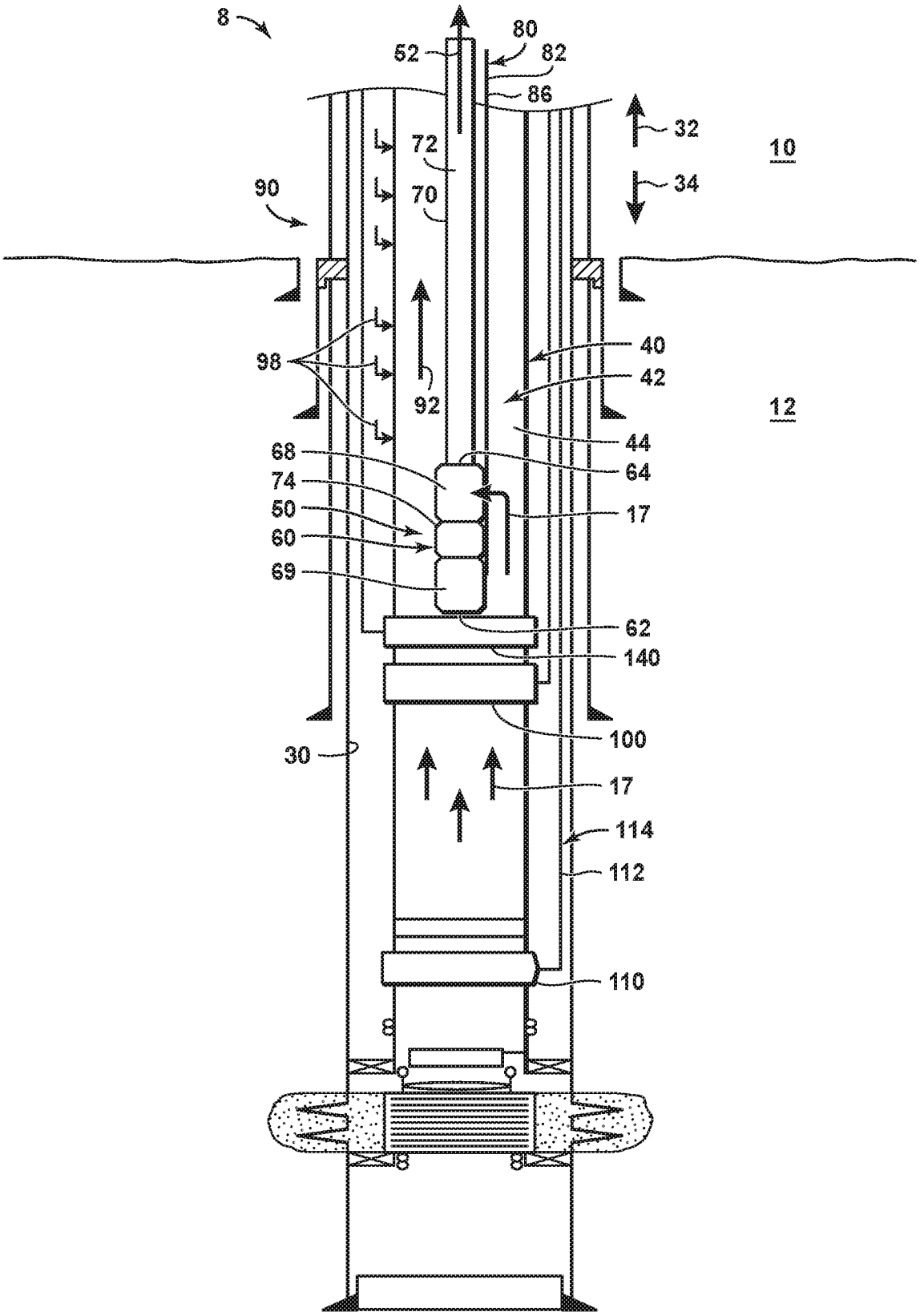
FIG. 3 is a less schematic cross-sectional view of a hydrocarbon well, according to the present disclosure, that includes an electric pumping assembly and a gas lift assembly.

FIGS. 1-3 are schematic cross-sectional views of hydrocarbon wells 8, according to the present disclosure. Hydrocarbon wells 8 include a wellbore 30, which extends between a surface region 10 and a subterranean formation 14 that includes a reservoir fluid 17. Wellbore 30 also may be referred to herein as extending within a subsurface region 12. FIG. 1 illustrates that wellbore 30 may extend to and/or terminate within surface region 10, while FIG. 2 illustrates that the wellbore may extend to and/or terminate within a subsea region 13. FIG. 3 provides a more detailed view of a portion of a hydrocarbon well 8 that may include and/or be the hydrocarbon well of FIG. 1 and/or FIG. 2.

Hydrocarbon well 8 includes a downhole tubular 40, an electric pumping assembly 50, an electric power source 78 (as illustrated in FIG. 1), and a gas lift assembly 90. Downhole tubular 40 extends within wellbore 30 and defines a tubular conduit 42.

Electric pumping assembly 50 includes an electric submersible pump (ESP) 60 and an ESP tubular 70 that defines an ESP conduit 72. ESP 60 includes an ESP inlet 62, which is configured to receive reservoir fluid 17 into the ESP, and an ESP outlet 64. Electric power source 78 is in electrical communication with ESP 60 and is configured to provide an electric current to the ESP to power the ESP. ESP 60 is configured to pressurize reservoir fluid 17 to generate a pumped reservoir fluid stream 52, which is discharged from ESP outlet 64. ESP 60 is operatively attached to ESP tubular 70 such that the ESP conduit receives the pumped reservoir fluid stream from the ESP outlet and/or such that the ESP outlet provides the pumped reservoir fluid stream to ESP conduit 72. Electric pumping assembly 50 is positioned within tubular conduit 42 such that ESP tubular 70 and downhole tubular 40 define an annular space 44 therebetween, and ESP tubular 70 fluidly isolates, or separates, ESP conduit 72 from annular space 44.

Gas lift assembly 90 includes a lift gas source 94, a lift gas injection point 98, and a lift gas supply conduit 95. Lift gas source 94 is configured to generate, to produce, and/or to supply a lift gas stream 96, which is conveyed from the lift gas source to lift gas injection point 98 via lift gas supply conduit 95, as illustrated in FIGS. 1-2. Lift gas injection point 98 is configured to inject the lift gas stream into annular space 44 to generate a gas lifted reservoir fluid stream 92 within the annular space. As illustrated in FIGS. 1-3, lift gas injection point 98 generally is located and/or positioned uphole, or in an uphole direction 32, from ESP inlet 62. Stated another way, ESP 60 generally is downhole, or in a downhole direction 34, from lift gas injection point 98. Such a configuration limits, restricts, and/or prevents flow of lift gas stream 96 into ESP 60, thereby improving a pumping efficiency of ESP 60.

During operation of hydrocarbon well 8, ESP inlet 62 of electric pumping assembly 50 and lift gas injection point 98 of gas lift assembly 90 both may be submerged within reservoir fluid 17; and the electric pumping assembly and the gas lift assembly both may be utilized to pump the reservoir fluid from the subterranean formation and/or to, or into, the surface region. As an example, the electric pumping assembly and the gas lift assembly may be operated, or utilized, concurrently to generate both pumped reservoir fluid stream 52 and gas lifted reservoir fluid stream 92 at the same time. Such a configuration may permit hydrocarbon well 8 to produce a greater volume of reservoir fluid 17, or to produce the reservoir fluid at a greater production rate, than would be possible utilizing either the electric pumping assembly or the gas lift assembly alone.

As another example, the electric pumping assembly and the gas lift assembly may be utilized separately, independently, and/or sequentially. As an example, the electric pumping assembly may be utilized to initiate production of the reservoir fluid from the hydrocarbon well, and the gas lift assembly may be utilized, with our without concurrent operation of the electric pumping assembly, once production is initiated. Such a configuration may be beneficial in gas-constrained formations, where the hydrocarbon well initially may not produce enough gas to permit economical operation of the gas lift assembly.

The hydrocarbon wells disclosed herein may provide several additional benefits over conventional hydrocarbon wells. As an example, electric pumping assembly 50 may be installed within tubular conduit 42 utilizing coiled tubing as ESP tubular 70 and/or utilizing a coiled tubing rig, which permits a cheaper and/or faster installation when compared to conventional ESPs, which are operatively attached to jointed pipe. As another example, electric pumping assembly 50 may be installed within tubular conduit 42 while maintaining a seal on the tubular conduit and/or within the surface region, thereby avoiding unnecessary depressurization of wellbore 30.

As discussed, annular space 44 is fluidly isolated from tubular conduit 42, thereby permitting independent operation of electric pumping assembly 50 and gas lift assembly 90 and/or permitting pumped reservoir fluid stream 52 and gas lifted reservoir fluid stream 92 to flow separately and/or independently from the subterranean formation. Stated another way, hydrocarbon well 8 may be configured to maintain separation between the pumped reservoir fluid stream and the gas lifted reservoir fluid stream while the pumped reservoir fluid stream and the gas lifted reservoir fluid stream flow within the wellbore.

With this spatial separation of the pumped reservoir fluid stream and the gas lifted reservoir fluid stream in mind, the electric pumping assembly and the gas lift assembly may be referred to herein as being configured to generate two distinct streams and/or as not being configured to pump the same, or a single, stream. Such spatial separation may permit a variety of temporal operation strategies to be employed. As examples, the electric pumping assembly and the gas lift assembly may be configured for concurrent operation, for at least partially concurrent operation, for independent operation, for sequential operation, and/or for at least partially sequential operation.

This fluid isolation may extend along a length, or an entirety of the length, of ESP conduit 72 and/or of annular space 44. Such a configuration may provide flexibility with regard to independent, concurrent, simultaneous, staged, and/or staggered operation of the electric pumping assembly and the gas lift assembly, as discussed herein.

Hydrocarbon well 8 may be configured to combine, to comingle, and/or to intermingle pumped reservoir fluid stream 52 and gas lifted reservoir fluid stream 92. As an example, hydrocarbon well 8 may include a surface tree 24, as illustrated in FIG. 1, and downhole tubular 40 and ESP tubular 70 both may be operatively attached to and/or in fluid communication with the surface tree. Under these conditions, the annular space and the ESP conduit may be fluidly isolated from one another between ESP inlet 62 and surface tree 24. However, surface tree 24 may be configured to mix and/or to combine the pumped reservoir fluid stream and the gas lifted reservoir fluid stream to produce and/or generate a product stream 22. As an example, surface tree 24 may include a ported tubing hanger 26 that is configured to combine, or that permits combination of, the pumped reservoir fluid stream and the gas lifted reservoir fluid stream.

As another example, surface tree 24 may maintain fluid isolation between the pumped reservoir fluid stream and the gas lifted reservoir fluid stream. Under these conditions, hydrocarbon well 8 further may include a mixing point 28, as illustrated in FIG. 1, that is downstream from the surface tree. The mixing point may be configured to combine, or mix, the pumped reservoir fluid stream and the gas lifted reservoir fluid stream to produce and/or generate the product stream.

Gas lift assembly 90 may include any suitable structure that injects lift gas stream 96 at lift gas injection point 98 and/or that produces gas lifted reservoir fluid stream 92 within annular space 44, including those structures discussed herein. As illustrated in FIGS. 1-2, gas lift assembly 90 further may include a gas lift valve 99, which may be configured to selectively, or periodically, inject the lift gas stream at the lift gas injection point.

It is within the scope of the present disclosure that gas lift assembly 90 may be configured for continuous, intermittent, and/or periodic operation and/or production of gas lifted reservoir fluid stream 92. It is also within the scope of the present disclosure that gas lift assembly 90 may include any suitable number of lift gas injection points 98. As examples, gas lift assembly 90 may include 1, 2, 3, 4, more than 4, and/or a plurality of lift gas injection points 98.

ESP 60 may include any suitable structure that includes ESP inlet 62 and ESP outlet 64, that is configured to generate pumped reservoir fluid stream 52, and/or that is configured to provide the pumped reservoir fluid stream to ESP conduit 72. In addition, ESP 60 may have any suitable size and/or dimension. As an example, the ESP may be sized to be positioned within tubular conduit 42 subsequent to downhole tubular 40 being positioned within wellbore 30. As a more specific example, ESP 60 may define a maximum transverse cross-sectional extent 66, and tubular conduit 42 may define a minimum transverse cross-sectional extent 46, as illustrated in FIG. 1. Under these conditions, maximum transverse cross-sectional extent 66 may be less than a threshold fraction of minimum transverse cross-sectional extent 46. Examples of the threshold fraction include threshold fractions of less than 98%, less than 95%, less than 90%, less than 85%, or less than 80% of minimum transverse cross-sectional extent 46.

It is within the scope of the present disclosure that ESP 60 may include an ESP pumping assembly 68 and an ESP motor 69. ESP pumping assembly 68 may be configured to pump reservoir fluid 17 and/or to generate pumped reservoir fluid stream 52.

ESP motor 69 may be in electrical communication with electric power source 78 and/or may be configured to power the ESP pumping assembly. Depending upon the configuration of hydrocarbon well 8 and/or of electric pumping assembly 50, ESP motor 69 may be positioned within wellbore 30, at least partially submerged within reservoir fluid 17, spaced-apart from ESP pumping assembly 68, and/or external to wellbore 30. When the ESP motor is spaced-apart from the ESP pumping assembly and/or is external to the wellbore, electric pumping assembly 50 further may include a mechanical linkage 74, as illustrated in FIGS. 1 and 3, that extends between and/or that mechanically interconnects the ESP motor and the ESP pumping assembly.

Examples of ESP motor 69 include any suitable permanent magnet motor and/or AC induction motor, and ESP motor 69 may have any suitable maximum rotational velocity. Examples of the maximum rotational velocity include maximum rotational velocities of 10,000 revolutions per minute (RPM), 11,000 RPM, 12,000 RPM, 13,000 RPM, 14,000 RPM, 15,000 RPM, 16,000 RPM, 18,000 RPM, or 20,000 RPM. Examples of ESP pumping assembly 68 include any suitable pump, centrifugal pump, positive displacement pump, bellows pump, progressive cavity pump, rotary vane pump, and/or gerotor pump.

It is within the scope of the present disclosure that ESP pumping assembly 68 and ESP motor 69 may have any suitable orientation, or relative orientation, within tubular conduit 42. As an example, ESP motor 69 may be uphole from ESP pumping assembly 68. As another example, the ESP motor may be downhole from the ESP pumping assembly.

As discussed, and as illustrated in FIGS. 1 and 3, electric power source 78 may be configured to provide an electric current 82 to ESP 60, such as to power the ESP, and it is within the scope of the present disclosure that electric power source 78 may include any suitable structure. As an example, and as illustrated in FIG. 1, the electric power source may include a power cable 80. Power cable 80, when present, may be operatively attached to an external surface of ESP tubular 70, may be operatively attached to an internal surface of ESP tubular, may extend within wellbore 30, may extend within ESP conduit 72, and/or may extend within annular space 44. In a specific example, power cable 80 may extend within wellbore 30 and external to tubular conduit 72. In this example, downhole tubular 70 may include a wet mate connector 84, which extends through the downhole tubular, and ESP 60 may be in electrical communication with power cable 80 via wet mate connector 84 and/or may be configured to receive electric current 82 from power cable 80 via the wet mate connector.

It is within the scope of the present disclosure that power cable 80, when present, may be configured to resist degradation from contact with reservoir fluid 17 and/or with lift gas stream 96. As an example, the power cable may include a shielding structure 86 configured to resist diffusion of lift gas, from the lift gas stream, into the power cable. Examples of the shielding structure include shielding structures formed from a gas-impermeable material, from an at least substantially gas-impermeable material, from a metal, and/or from lead.

With continued reference to FIG. 1, it is within the scope of the present disclosure that wellbore 30 may extend within both a first subterranean formation 15, which includes a first reservoir fluid 18, and a second subterranean formation 16, which includes a second reservoir fluid 19. The first subterranean formation may be uphole from the second subterranean formation. Under these conditions, electric pumping assembly 50 may be configured to generate pumped reservoir fluid stream 52 from second reservoir fluid 19, and gas lift assembly 90 may be configured to generate gas lifted reservoir fluid stream 92 from first reservoir fluid 18.

As illustrated in dashed and in dash-dot lines in FIG. 1 and in solid lines in FIG. 3, hydrocarbon well 8 may include a surface controlled subsurface safety valve (SCSSV) 100. SCSSV 100, when present, may be configured to be selectively actuated, such as via a control signal 122 generated by a controller 120 and/or conveyed by a control linkage 124, as illustrated in FIG. 1. This may include actuation between an open state, in which the SCSSV permits fluid flow therethrough, and a closed state, in which the SCSSV restricts fluid flow therethrough. It is within the scope of the present disclosure that ESP 60 may be uphole from SCSSV 100, as illustrated in dashed lines in FIG. 1 and in solid lines in FIG. 3. Alternatively, it is also within the scope of the present disclosure that ESP 60 may be downhole from SCSSV 100, as illustrated in dash-dot and in dash-dot-dot lines in FIG. 1. Similarly, lift gas injection point 98 may be uphole from the SCSSV, as illustrated in dashed and in dash-dot-dot lines in FIG. 1, or downhole from the SCSSV, as illustrated in dash-dot lines in FIG. 1. SCSSV 100 additionally or alternatively may extend between ESP 60 and gas lift injection point 98, as illustrated in dash-dot-dot lines in FIG. 1.

When the ESP is downhole from the SCSSV, the SCSSV may be in, or may be locked in, the open state, such as to permit ESP tubular 70 to pass therethrough. Additionally or alternatively, SCSSV may include an aperture 102 configured to permit the ESP tubular to pass through the SCSSV when the SCSSV is in both the open state and the closed state.

As illustrated in FIG. 1, hydrocarbon well 8 also may include a downhole sensor 110, which may be configured to detect a property of the hydrocarbon well. Examples of the downhole sensor include a temperature sensor, a pressure sensor, a flow rate sensor, a bottom hole pressure sensor, a fiber optic sensor, an acoustic sensor, and/or a vibration sensor. As a more specific example, the downhole sensor may be configured to detect a flow rate of the pumped reservoir fluid stream.

Downhole sensor 110, when present, may be positioned within any suitable portion of hydrocarbon well 8. As examples, the downhole sensor may be positioned uphole from the ESP, may be positioned downhole from the ESP, may be operatively attached to the ESP, may be positioned uphole from the lift gas injection point, may be positioned downhole from the lift gas injection point, and/or may be positioned at the lift gas injection point.

Downhole sensor 110 may be configured to generate a sensor signal 112, which may be indicative of the property of the hydrocarbon well. Under these conditions, controller 120 may be configured to receive the sensor signal, and hydrocarbon well 8 may include a communication linkage 114 configured to convey the sensor signal from the downhole sensor to the controller.

It is within the scope of the present disclosure that controller 120 further may be adapted configured, and/or programmed to control the operation of electric pumping assembly 50 and/or of gas lift assembly 90 based, at least in part, on sensor signal 112. As an example, controller 120 may be configured to generate a control signal 122 that is based, at least in part, on the sensor signal. As another example, controller 120 may be configured to provide the control signal to the electric pumping assembly and/or to the gas lift assembly. This may include providing the control signal via a wired and/or wireless communication linkage, such as communication linkage 114. When communication linkage 114 includes the wired communication linkage, the wired communication linkage may extend within power cable 80, when present, may be operatively attached to the power cable, and/or may be distinct from the power cable.

Controller 120 may control the operation of the electric pumping assembly and/or of the gas lift assembly in any suitable manner. As examples, controller 120 may be programmed to efficiently operate the electric pumping assembly and the gas lift assembly, to improve, or increase, production of the reservoir fluid, to improve, or decrease, energy consumption of the hydrocarbon well, and/or to regulate a rotational speed of the ESP.

As illustrated in dashed lines in FIG. 1 and in solid lines in FIG. 3, hydrocarbon well 8 also may include a chemical injection structure 140. Chemical injection structure 140 may be configured to inject a chemical into wellbore 30, and the chemical may be injected to condition downhole hardware and/or to improve flow performance within the hydrocarbon well. Chemical injection structure 140, when present, may be positioned downhole from ESP 60, as illustrated. However, this is not required of all embodiments of hydrocarbon wells 8 according to the present disclosure.

As also illustrated in dashed lines in FIG. 1, hydrocarbon well 8 and/or downhole tubular 40 further may include a Y-tool 130. Y-tool 130 may be a conventional Y-tool that may be configured to permit and/or to facilitate wireline access to a portion of tubular conduit 42 that is downhole from ESP 60.

ESP tubular 70 may include any suitable tubular that may extend within downhole tubular 40, that may be operatively attached to ESP 60, and/or that may define ESP conduit 72. Examples of ESP tubular 70 include coiled tubing, jointed pipe, and/or a power/hydraulic umbilical.

Downhole tubular 40 may include any suitable structure that may define tubular conduit 42. Examples of downhole tubular 40 include production tubing and/or jointed pipe.

Hydrocarbon well 8 may include, or be, a surface-based hydrocarbon well, as illustrated in FIG. 1. Under these conditions, electric pumping assembly 50 and/or gas lift assembly 90 may be positioned within a portion of downhole tubular 40 that extends within wellbore 30.

Alternatively, hydrocarbon well 8 also may include, or be, a subsea hydrocarbon well, as illustrated in FIG. 2. Under these conditions, downhole tubular 40 may include, define, and/or form a portion of a production riser 41 that extends between a seafloor 20 and an oil rig 9; and electric pumping assembly 50 and/or gas lift assembly 90 may be positioned within the production riser. As illustrated schematically in dashed lines in FIG. 2, it is within the scope of the present disclosure that production riser 41 may be associated with and/or may fluidly interconnect any suitable number, or a plurality, of wellbores 30 and/or of corresponding downhole tubulars 40 with oil rig 9.

Wellbore 30 may include and/or be any suitable wellbore that extends within subsurface region 12 and/or within subterranean formation 14. As examples, and as illustrated in FIG. 1, wellbore 30 may include one or more of a vertical, or at least substantially vertical, region 36, and/or a deviated, horizontal, and/or at least substantially horizontal region 38.

Figure 4:
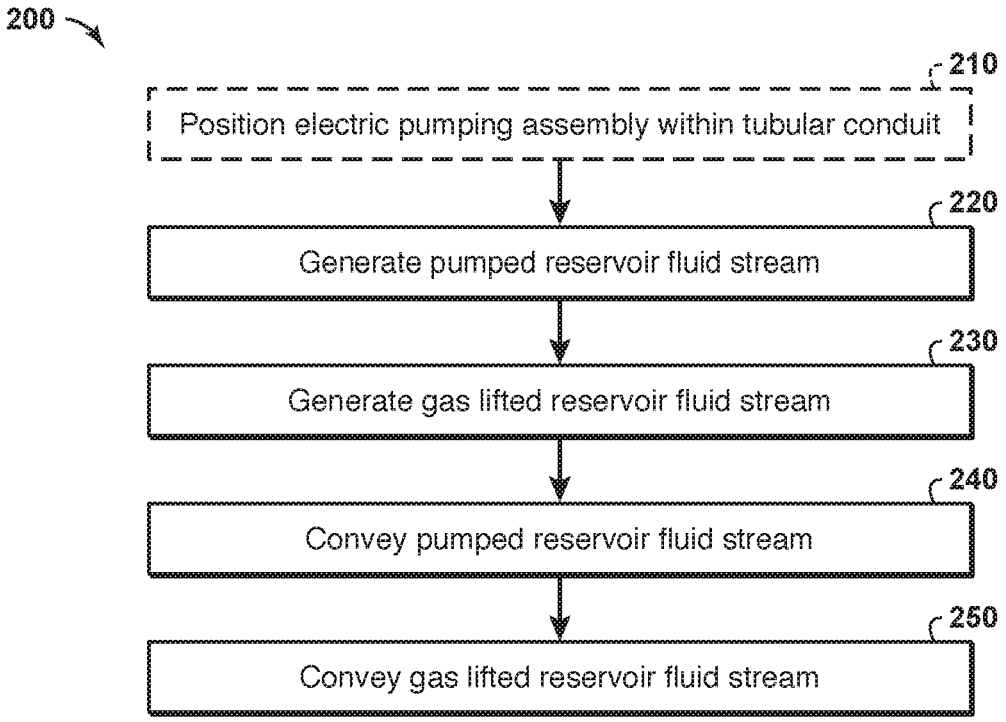
FIG. 4 is a flowchart depicting methods, according to the present disclosure, of producing a reservoir fluid from a subterranean formation.

FIG. 4 is a flowchart depicting methods 200, according to the present disclosure, of producing a reservoir fluid from a subterranean formation. Methods 200 may include positioning an electric pumping assembly within a tubular conduit at 210 and include generating a pumped reservoir fluid stream at 220. Methods 200 further include generating a gas lifted reservoir fluid stream at 230, conveying the pumped reservoir fluid stream at 240, and conveying the gas lifted reservoir fluid stream at 250.

Positioning the electric pumping assembly within the tubular conduit at 210 may be performed prior to the generating at 220, prior to the generating at 230, prior to the conveying at 240, and/or prior to the conveying at 250. The positioning at 210 may include positioning any suitable electric pumping assembly within any suitable tubular conduit, which is defined by a downhole tubular. The downhole tubular may extend within a wellbore, which extends within a subterranean formation that includes the reservoir fluid. The electric pumping assembly may include an electric submersible pump (ESP), which is configured to generate the pumped reservoir fluid stream during the generating at 220, and an ESP tubular, which defines an ESP conduit. The ESP may be operatively attached to the ESP tubular such that the ESP conduit receives the pumped reservoir fluid stream from the ESP. In addition, the ESP tubular and the downhole tubular may define an annular space therebetween. Examples of the electric pumping assembly, the ESP, and the ESP tubular are disclosed herein with reference to electric pumping assembly 50, ESP 60, and ESP tubular 70, respectively, of FIGS. 1-3.

The ESP tubular may include coiled tubing. Under these conditions, the positioning at 210 may include positioning with, via, and/or utilizing a coiled tubing rig.

It is within the scope of the present disclosure that the positioning at 210 may include positioning such that an inlet of the ESP is downhole from a location, within the annular space, at which the gas lifted reservoir fluid stream is generated during the generating at 230. It is also within the scope of the present disclosure that the positioning at 210 may include maintaining fluid isolation between the tubular conduit and a surface region.

Generating the pumped reservoir fluid stream at 220 may include generating the pumped reservoir fluid stream with, via, and/or utilizing the electric pumping assembly. Generating the gas lifted reservoir fluid stream at 230 may include generating with, via, and/or utilizing a gas lift assembly. Examples of the gas lift assembly are disclosed herein with reference to gas lift assembly 90 of FIGS. 1-3.

It is within the scope of the present disclosure that the generating at 220 and the generating at 230 may be performed in any suitable order and/or with any suitable sequencing. As examples, the generating at 220 and the generating at 230 may be performed concurrently, at least partially concurrently, sequentially, and/or at least partially sequentially.

As a more specific example, methods 200 may include initiating the generating at 220 prior to initiating the generating at 230. Under these conditions, the generating at 230 may include injecting a lift gas stream into the annular space, and a portion of the pumped reservoir fluid stream, which is generated during the generating at 220, may be utilized as the lift gas stream.

It is also within the scope of the present disclosure that the generating at 220 and the generating at 230 may include generating the pumped reservoir fluid stream downhole from the gas lifted reservoir fluid stream. Such a configuration may increase an efficiency of the generating at 220 by avoiding entry of the gas lifted reservoir fluid stream and/or of the lift gas stream, which generates the gas lifted reservoir fluid stream, into the electric pumping assembly that is utilized to generate the pumped reservoir fluid stream.

Conveying the pumped reservoir fluid stream at 240 may include conveying the pumped reservoir fluid stream, via the ESP conduit, from the electric pumping assembly and to the surface region. Conveying the gas lifted reservoir fluid stream at 250 may include conveying the gas lifted reservoir fluid stream, via the annular space, from the gas lift assembly to the surface region. The annular space may be separate, distinct, and/or fluidly isolated from the ESP conduit, as discussed herein. Similar to the generating at 220 and the generating at 230, the conveying at 240 and the conveying at 250 may be performed concurrently, at least partially concurrently, sequentially, and/or at least partially sequentially.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The hydrocarbon wells and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What we claim:

1. A hydrocarbon well, comprising:

a wellbore extending between a surface region and a subterranean formation that includes a reservoir fluid;

a downhole tubular defining a tubular conduit and extending within the wellbore;

an electric pumping assembly including an electric submersible pump (ESP) and an ESP tubular defining an ESP conduit, wherein:

(i) the ESP includes an ESP inlet configured to receive the reservoir fluid into the ESP, wherein the ESP is configured to pressurize the reservoir fluid to generate a pumped reservoir fluid stream, and further wherein the ESP includes an ESP outlet configured to discharge the pumped reservoir fluid stream from the ESP;

(ii) the ESP is operatively attached to the ESP tubular such that the ESP conduit receives the pumped reservoir fluid stream from the ESP outlet; and (iii) the electric pumping assembly is positioned within the tubular conduit such that the ESP tubular and the downhole tubular define an annular space therebetween, wherein the ESP tubular fluidly isolates the ESP conduit from the annular space;

an electric power source in electrical communication with the ESP and configured to provide an electric current to the ESP to power the ESP; and a gas lift assembly including:

(i) a lift gas source configured to generate a lift gas stream;

(ii) a lift gas injection point configured to inject the lift gas stream into the annular space to generate a gas lifted reservoir fluid stream, wherein the lift gas injection point is uphole from the ESP inlet; and (iii) a lift gas supply conduit configured to convey the lift gas stream from the lift gas source to the lift gas injection point.

2. The hydrocarbon well of claim 1, wherein the annular space and the ESP conduit are fluidly isolated from one another along a length of the ESP conduit.

3. The hydrocarbon well of claim 1, wherein the hydrocarbon well further includes a surface tree, wherein the downhole tubular and the ESP tubular are operatively attached to the surface tree, and further wherein the annular space and the ESP conduit are fluidly isolated from one another between the ESP inlet and the surface tree.

4. The hydrocarbon well of claim 3, wherein the surface tree at least one of:

(i) is configured to combine the pumped reservoir fluid stream and the gas lifted reservoir fluid stream to generate a product stream; and (ii) maintains fluid isolation between the pumped reservoir fluid stream and the gas lifted reservoir fluid stream.

5. The hydrocarbon well of claim 1, wherein the lift gas injection point is a first lift gas injection point, wherein the gas lift assembly includes a plurality of lift gas injection points spaced-apart along a length of the annular space.

6. The hydrocarbon well of claim 1, wherein the gas lift assembly includes a gas lift valve configured to selectively inject the lift gas stream at the lift gas injection point.

7. The hydrocarbon well of claim 1, wherein the ESP is sized to be positioned within the tubular conduit subsequent to the downhole tubular being positioned within the wellbore.

8. The hydrocarbon well of claim 1, wherein the ESP defines a maximum transverse cross-sectional extent, wherein the tubular conduit defines a minimum transverse cross-sectional extent, and further wherein the maximum transverse cross-sectional extent of the ESP is less than 95% of the minimum transverse cross-sectional extent of the tubular conduit.

9. The hydrocarbon well of claim 1, wherein the ESP includes an ESP pumping assembly, which is configured to generate the pumped reservoir fluid stream, and an ESP motor, which is in electrical communication with the electric power source and configured to power the ESP pumping assembly.

10. The hydrocarbon well of claim 9, wherein the ESP motor at least one of:

(i) is a permanent magnet motor;

(ii) is an AC induction motor; and (iii) has a maximum rotational velocity of 15,000 revolutions per minute.

11. The hydrocarbon well of claim 9, wherein the ESP motor at least one of:

(i) is at least partially submerged within the reservoir fluid; and (ii) is external to the wellbore.

12. The hydrocarbon well of claim 9, wherein the ESP further includes a mechanical linkage extending between the ESP pumping assembly and the ESP motor.

13. The hydrocarbon well of claim 9, wherein the ESP pumping assembly includes at least one of:

(i) a positive displacement pump;

(ii) a bellows pump;

(iii) a progressive cavity pump;

(iv) a rotary vane pump;

(v) a centrifugal pump; and (vi) a gerotor pump.

14. The hydrocarbon well of claim 1, wherein the subterranean formation is a first subterranean formation, wherein the reservoir fluid is a first reservoir fluid, wherein the wellbore also extends within a second subterranean formation that includes a second reservoir fluid, and further wherein:

(i) the electric pumping assembly is configured to generate the pumped reservoir fluid stream from the second reservoir fluid; and (ii) the gas lift assembly is configured to generate the gas lifted reservoir fluid stream from the first reservoir fluid.

15. The hydrocarbon well of claim 1, wherein the hydrocarbon well further includes a surface controlled subsurface safety valve (SCSSV), wherein the ESP is uphole from the SCSSV.

16. The hydrocarbon well of claim 1, wherein the hydrocarbon well further includes a surface controlled subsurface safety valve (SCSSV), wherein the ESP is downhole from the SCSSV, and further wherein at least one of:

(i) the SCSSV is locked in an open state; and (ii) the SCSSV includes an aperture configured to permit the ESP tubular to pass therethrough, wherein the SCSSV defines the open state, in which the SCSSV permits fluid communication therethrough, and a closed state, in which the SCSSV restricts fluid communication therethrough.

17. The hydrocarbon well of claim 1, wherein the hydrocarbon well further includes a downhole sensor configured to detect a property of the hydrocarbon well, wherein the downhole sensor includes at least one of:

(i) a temperature sensor;

(ii) a pressure sensor;

(iii) a flow rate sensor;

(iv) a bottom hole pressure sensor;

(v) a fiber optic sensor;

(vi) an acoustic sensor; and (vii) a vibration sensor.

18. The hydrocarbon well of claim 17, wherein the downhole sensor is configured to generate a sensor signal indicative of the property of the hydrocarbon well, and further wherein the hydrocarbon well further includes:

(i) a controller configured to receive the sensor signal from the downhole sensor; and (ii) a communication linkage configured to convey the sensor signal from the downhole sensor to the controller.

19. The hydrocarbon well of claim 18, wherein the controller is programmed to control the operation of at least one of the electric pumping assembly and the gas lift assembly based, at least in part, on the sensor signal.

20. The hydrocarbon well of claim 1, wherein at least one of:

(i) the electric pumping assembly is positioned within a portion of the downhole tubular that extends within the wellbore; and (ii) the downhole tubular further includes a production riser that extends from the wellbore, and further wherein the electric pumping assembly is positioned within the production riser.

21. The hydrocarbon well of claim 1, wherein the hydrocarbon well is configured to maintain separation between the pumped reservoir fluid stream and the gas lifted reservoir fluid stream while the pumped reservoir fluid stream and the gas lifted reservoir fluid stream flow within the wellbore.

22. A method of producing a reservoir fluid from a subterranean formation, the method comprising:

positioning a downhole tubular defining a tubular conduit into a wellbore extending from a surface location into the subterranean formation;

positioning an electric submersible pump (ESP) within the tubular conduit via an ESP conduit such that the ESP tubular and the downhole tubular define an annular space therebetween, wherein the ESP tubular fluidly isolates the ESP conduit from the annular space;

generating, with the ESP a pumped reservoir fluid stream within the ESP conduit from the ESP;

injecting a gas lift gas stream into the annular space and then into the ESP conduit at a gas lift gas injection point for the injected gas lift gas stream to combine with the pumped reservoir fluid stream pumped by the ESP as a gas lifted reservoir fluid stream, within the ESP conduit;

conveying the combined pumped reservoir fluid stream and gas lift gas stream as the gas lifted reservoir fluid stream, via the ESP conduit, from the gas lift gas injection point to a surface region.

23. The method of claim 22, wherein the method includes initiating the generating the pumped reservoir fluid stream prior to initiating the generating the gas lifted reservoir fluid stream.

24. The method of claim 23, wherein the generating the gas lifted reservoir fluid stream includes injecting a lift gas stream into the annular space, and further wherein the method includes utilizing a portion of the pumped reservoir fluid stream as the lift gas stream.

25. The method of claim 22, wherein the generating the pumped reservoir fluid stream includes generating the pumped reservoir fluid stream downhole from the generating the gas lifted reservoir fluid stream.

26. The method of claim 22 wherein, prior to the generating the pumped reservoir fluid stream, the method further includes positioning the electric pumping assembly within a tubular conduit of a downhole tubular, wherein the electric pumping assembly includes an electric submersible pump (ESP), which is configured to generate the pumped reservoir fluid stream, and an ESP tubular, which defines the ESP conduit, wherein the ESP is operatively attached to the ESP tubular such that the ESP conduit receives the pumped reservoir fluid stream from the ESP, and further wherein the annular space is defined between the downhole tubular and the ESP tubular.

* * * * *